US006773337B1

(12) United States Patent
Dabral et al.

(10) Patent No.: US 6,773,337 B1
(45) Date of Patent: Aug. 10, 2004

(54) METHOD AND APPARATUS TO RECONDITION AN ION EXCHANGE POLISH PAD

(75) Inventors: Sanjay Dabral, Palo Alto, CA (US); Anil K. Pant, Santa Clara, CA (US)

(73) Assignee: Planar Labs Corporation, Sunnyvale, CA (US)

( * ) Notice: Subject to any disclaimer, the term of this patent is extended or adjusted under 35 U.S.C. 154(b) by 0 days.

(21) Appl. No.: 09/993,809

(22) Filed: Nov. 6, 2001

Related U.S. Application Data

(60) Provisional application No. 60/246,364, filed on Nov. 7, 2000, provisional application No. 60/246,352, filed on Nov. 7, 2000, and provisional application No. 60/246,351, filed on Nov. 7, 2000.

(51) Int. Cl.[7] ..... B24B 1/00
(52) U.S. Cl. ..... 451/56; 451/443; 451/444
(58) Field of Search ..... 451/56, 41, 443, 451/54, 287, 28, 444, 288, 285

(56) References Cited

U.S. PATENT DOCUMENTS

| | | | | |
|---|---|---|---|---|
| 4,839,005 A | | 6/1989 | Katsumoto et al. | |
| 4,927,432 A | | 5/1990 | Bidomger et al. | |
| 5,045,210 A | * | 9/1991 | Chen et al. | 210/679 |
| 5,205,082 A | | 4/1993 | Shendon et al. | |
| 5,329,732 A | | 7/1994 | Karlsrud et al. | |
| 5,443,416 A | | 8/1995 | Volodarsky et al. | |
| 5,453,312 A | | 9/1995 | Haas et al. | |
| 5,556,553 A | * | 9/1996 | Krulik et al. | 216/105 |
| 5,558,568 A | | 9/1996 | Talieh et al. | |
| 5,578,362 A | | 11/1996 | Reinhardt et al. | |
| 5,685,766 A | * | 11/1997 | Mattingly et al. | 451/36 |
| 5,692,947 A | | 12/1997 | Talieh et al. | |
| 5,735,729 A | | 4/1998 | Kobayashi et al. | |
| 5,762,536 A | | 6/1998 | Pant et al. | |
| 5,800,248 A | | 9/1998 | Pant et al. | |
| 5,807,165 A | | 9/1998 | Uzoh et al. | |
| 5,844,030 A | * | 12/1998 | Andros | 524/237 |
| 5,871,390 A | | 2/1999 | Pant et al. | |
| 5,885,137 A | * | 3/1999 | Ploessl | 451/56 |
| 5,911,619 A | | 6/1999 | Uzoh et al. | |
| 5,916,010 A | * | 6/1999 | Varian et al. | 451/287 |
| 5,916,012 A | | 6/1999 | Pant et al. | |
| 5,921,853 A | * | 7/1999 | Nishio | 451/289 |
| 5,968,333 A | | 10/1999 | Nogami et al. | |
| 6,004,193 A | * | 12/1999 | Nagahara et al. | 451/285 |
| 6,004,880 A | | 12/1999 | Liu et al. | |
| 6,066,030 A | | 5/2000 | Uzoh | |
| 6,090,239 A | | 7/2000 | Liu et al. | |

(List continued on next page.)

FOREIGN PATENT DOCUMENTS

WO WO 01/71068 A1 9/2001

*Primary Examiner*—Hadi Shakeri
(74) *Attorney, Agent, or Firm*—Blakely Sokoloff Taylor & Zafman LLP

(57) ABSTRACT

In certain embodiments of the invention an ion exchange polish pad, which is used for polishing Copper layers formed on a semiconductor substrate, may be conditioned and/or reconditioned to regenerate its binding capacity for cations. Once bound to an ion exchange polish pad, cations for example may be exchanged for protons ($H^+$) by exposing the ion exchange polish pad to a reconditioning medium(s). The exchange of cations with $H^+$ reconditions the ion exchange material of an ion exchange polish pad so it is capable of binding and removing additional cations from a surface. In certain embodiments, a reconditioning head is used to recondition an ion exchange polish pad. A typical reconditioning process comprises elution of bound copper from ion exchange polish pad followed by protonation. Elution of bound copper may be accomplished by exposing an ion exchange polish pad to a strong acid solution, or similar chemical treatments.

7 Claims, 13 Drawing Sheets

U.S. PATENT DOCUMENTS 6,099,393 A * 8/2000 Katagiri et al. ..... 451/56
6,132,289 A 10/2000 Labunsky et al.
6,179,693 B1 * 1/2001 Beardsley et al. ..... 451/56
6,186,865 B1 2/2001 Thornton et al.
6,190,236 B1 * 2/2001 Drill ..... 451/285
6,200,207 B1 * 3/2001 Hsu ..... 451/443
6,224,461 B1 5/2001 Boehm, Jr. et al.
6,267,644 B1 * 7/2001 Molnar ..... 451/41
6,299,741 B1 10/2001 Sun et al.
6,309,969 B1 10/2001 Oskam et al.
6,312,321 B1 * 11/2001 Fukushima et al. ..... 451/285
6,328,042 B1 * 12/2001 Gotkis ..... 134/1.3
6,331,136 B1 * 12/2001 Bass et al. ..... 451/41
6,358,421 B1 * 3/2002 Newenhizen et al. ..... 210/673
6,419,567 B1 * 7/2002 Glashauser ..... 451/259
6,508,697 B1 * 1/2003 Benner et al. ..... 451/443
2002/0006767 A1 * 1/2002 Wang et al. ..... 451/41

* cited by examiner

METHOD AND APPARATUS TO RECONDITION AN ION EXCHANGE POLISH PAD

This application claims the benefit of priority from U.S. Provisional Patent Application Serial No. 60/246,364 entitled "Method of Fabricating a Polishing Pad That Uses Ion Exchange Resin" filed on Nov. 7, 2000; U.S. Provisional Patent Application Serial No. 60/246,352 entitled "Method and Apparatus for Conditioning and Recharging Ion Exchange Resin Based Pads Used for Polishing and Cleaning Applications" filed on Nov. 7, 2000; and U.S. Provisional Patent Application Serial No. 60/246,351 entitled "Method and Apparatus for Electrodynamic Chemical Mechanical Polishing and Deposition" filed on Nov. 7, 2000.

FIELD OF THE INVENTION

Embodiments of the invention relate to polishing semiconductor substrates. More particularly, embodiments of the invention relate to pads to perform chemical-mechanical polishing on semiconductor substrates or layers formed on such substrates.

BACKGROUND OF THE INVENTION

Integrated circuits are typically formed on substrates (for example silicon wafers) by the formation of various conductive, semiconductive and/or insulative layers. Although a layer may be etched after deposition to form a planarized surface, planarity may be improved with other techniques. Chemical mechanical polishing (CMP) is one accepted method of planarization, which tends to achieve improved planarity over an etch-back technique. CMP typically requires the substrate or wafer be mounted on a carrier or polishing head, with the surface of the layer to be polished exposed. The wafer is then placed against a moving (mechanical) polishing pad. The carrier head may rotate, as well as provide other motion between the wafer and the polishing surface. A polishing slurry, typically including an abrasive and at least one chemically reactive agent, may be introduced onto the polishing pad surface to provide the chemical component of CMP to polish the exposed surface.

When CMP is used on certain materials, such as a deposited copper layer of a semiconductor device, several problems may arise. First, copper generally has to be oxidized before a chemical slurry removes it. Second, dishing and erosion problems may occur between the abrasive particles in the slurry and copper, such as interconnects or lines on the wafer. To minimize dishing and erosion of a copper layer, polish pads have been manufactured with abrasive particles incorporated into the pad. However, these pads tend to introduce higher defects during polishing because the abrasives are fixed and, therefore, the friction is not a rolling friction. Pads with incorporated abrasive particles also may need special indexing mechanism and tooling to be implemented. Additionally, a continuous pad surface typically is desired because the abrasive is spent after a first pass. Another problem with using chemical slurry in CMP polishing of copper is that a copper containing waste stream may be generated and may present an environmental hazard that may require special handled.

A typical polishing pad includes a hard top layer and a softer bottom layer. The top layer has a high friction polishing surface, capable of transporting slurry, and the opposite surface adhesively bonded to a surface of the bottom layer. The opposite surface of the bottom layer is typically attached to a platen by a high strength pressure-sensitive adhesive layer.

Typically, a conventional polish pad serves at least two purposes: (1) It provides a mechanism to hold and transfer slurry and (2) it provides a frictional surface that helps in abrading the material being polished. Such conventional polish pads are generally made of cast polyurethane and non-woven impregnated polyurethane felts. Although these pads provide adequate CMP performance on various materials used in device fabrication, the existing pads have shortcomings in respect to polishing copper. Conventional polish pads and methods for CMP of copper suffer from the drawbacks of high dishing values, high defect values, poor margin for over polish, and the need for elaborate and expensive handling of the copper waste stream.

DETAILED DESCRIPTION OF THE INVENTION

Embodiments of the invention include an ion exchange polish pad, as well as methods of manufacture and use thereof. In an exemplary embodiment, an ion exchange polish pad comprises an ion exchange material, for example an ion exchange resin (IER). Cations in the ion exchange material may be exchanged with other cations, such as copper, under the proper process conditions.

In certain embodiments, cation binding capacity can be regenerated before, during, or after polishing by reconditioning of the ion exchange polish pad. An ion exchange polish pad may be reconditioned by exchanging bound cations with H+ ion to regenerate cation binding capacity. In other embodiments, methods and apparatus for reconditioning of an ion exchange polish pad are described.

Figure 1:
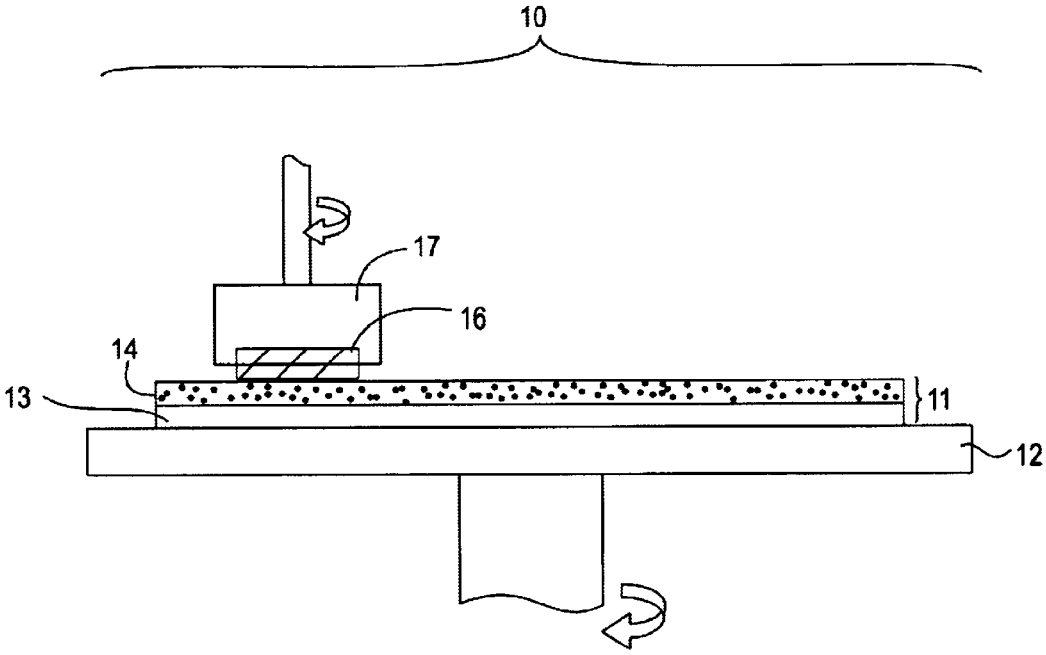
FIG. 1 illustrates an exemplary embodiment of a semiconductor polishing apparatus incorporating an ion exchange polish pad.

FIG. 1 is a longitudinal cross-sectional view showing the structure of an exemplary embodiment of a polishing apparatus 10 that incorporates an ion exchange polish pad 11 of the invention. A polishing platform (platen) 12 is shown operatively coupled to an ion exchange polish pad 11. The ion exchange polish pad 11 comprises a base layer 13 and at least one resin layer 14, the top most resin layer further comprising an ion exchange material either imbedded in and/or mixed throughout the resin layer The ion exchange material may be in a bead, powder, or other form. The base layer 13 is typically coupled to a moving mechanism, such as a rotating polishing platform 12 as shown, or some other moving device. For example, the polish pad 11 may be mounted on a linear polisher in the form of a belt, or on such a moving belt.

Exemplified in FIG. 1 is a typical semiconductor substrate 16 on which various layers of conductive, semiconductive and/or insulative materials may be formed. The semiconductor substrate 16 is shown coupled to a polishing head 17. The polishing head 17 is typically a mechanism, which may serve to both hold the semiconductor substrate 16 and to impart rotational movement to the semiconductor substrate 16. The semiconductor substrate 16 may be pressed against an ion exchange polish pad 11 for polishing. In alternative embodiments, an ion exchange polish pad 11 may be mounted on a linear polisher as a belt that moves in a linear motion across a semiconductor substrate 16.

Figure 2:
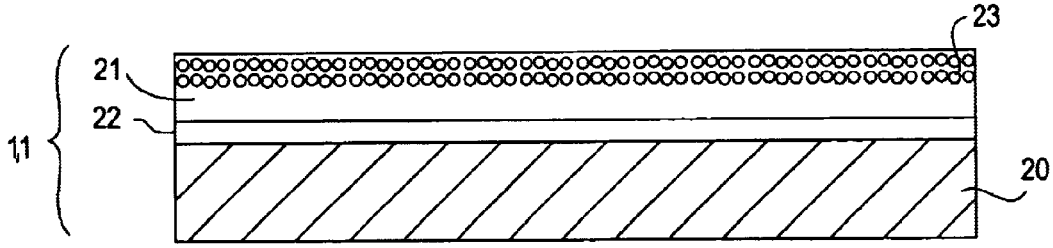
FIG. 2 illustrates an exemplary embodiment of an ion exchange polish pad.

FIG. 2 shows a longitudinal cross-sectional view of an exemplary embodiment of an ion exchange polish pad, such as the ion exchange polish pad 11 illustrated in FIG. 1. The pad comprises a base layer 20 and a resin layer 21. The top of the base layer 20 may be partially or entirely coated with an adhesive material 22 or the resin layer 21 bonds directly to the base layer 20. An ion exchange material 23 is embedded in the surface of the resin layer 21 opposite the adhesive material 22.

Figure 3:
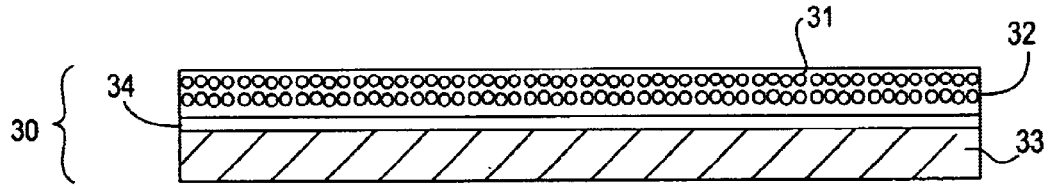
FIG. 3 illustrates an exemplary alternative embodiment of an ion exchange polish pad.

In an alternative embodiment, as shown in FIG. 3, an ion exchange polish pad 30 comprises an ion exchange material 31 mixed into the resin layer 32 during fabrication. The pad comprises a base layer 33 and a resin layer 32. The top of the base layer 31 may be partially or entirely coated with an adhesive material 34 or the resin layer 31 bonds directly to the base layer 33.

Figure 4:
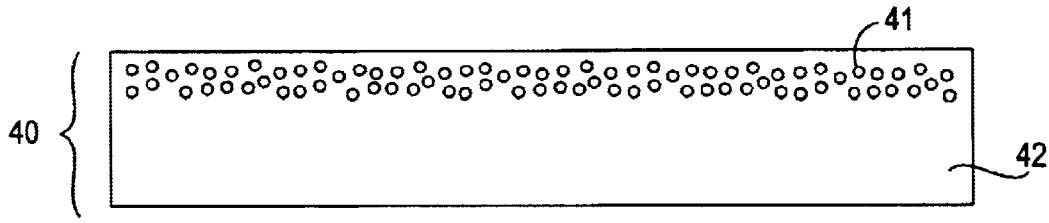
FIG. 4 illustrates another exemplary embodiment of an ion exchange polish pad.

In another embodiment, illustrated in FIG. 4, a one-layer ion exchange polish pad 40 has an ion exchange material 41 embedded in an appropriate resin layer 42, which may be coupled to a polishing platform. Thus, illustrating an example of a one-layer ion exchange polish pad. Alternatively, an ion exchange material may be combined with the resin layer during fabrication, thus being dispersed throughout the resin layer.

Figure 5:
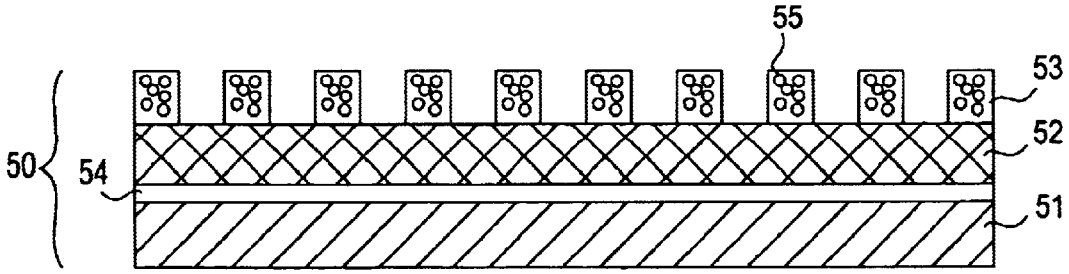
FIG. 5 illustrates yet another exemplary embodiment of an ion exchange polish pad.

FIG. 5 illustrates still another embodiment of an ion exchange polish pad 50. The ion exchange polish pad 50 comprises a base layer 51, a resin layer 52, and a patterned ion exchange/resin layer 53. The top of the base layer 51 may be partially or entirely coated with an adhesive material 54 or the resin layer 52 may bond to the base layer 51. The ion exchange/resin layer 53 comprises an ion exchange material 55, which may be embedded in or mix into the resin layer 53.

Figure 6:
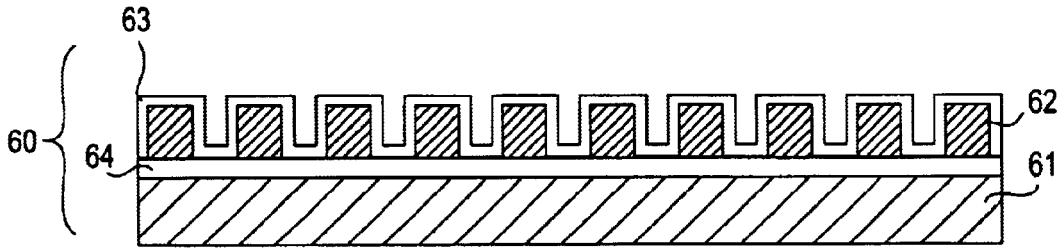
FIG. 6 illustrates still another alternative embodiment of an ion exchange polish pad.

FIG. 6 illustrates yet another embodiment of an ion exchange polish pad 60. The ion exchange polish pad 60 comprises a base layer 61, a patterned resin layer 62, and an ion exchange/resin layer 63. The top of the base layer 61 is partially or entirely coated with an adhesive material 64.

In alternative embodiments, an ion exchange material may be incorporated into a resin material before, during, or after polymerization of an ion exchange polish pad. For example, a polymer (e.g. polyurethane) may include one or more pre-polymers (e.g. monomers) and a cross linking reagent(s), including those that are known in the art. An ion exchange material, such as an ion exchange resin, a powdered ion exchange resin, or an ion exchange functional group, as described herein, may be combined with one or more polymer ingredients so that during fabrication of the resin into a pad or belt the ion exchange material may be incorporated. Ion exchange material may be physically sequestered within the polymer matrix, bonded to the matrix, chemically coupled to the matrix, electronically or laser grafted to the matrix, or attached in manner known to those skilled in the art. General polymerization techniques known to one skilled in the art may be used, such as free radical polymerization, suspension polymerization, and other known polymerization processes. In yet other embodiments an ion exchange material may be chemically or laser grafted, as is generally known in the art, onto the surface of a polish pad.

Figure 7:
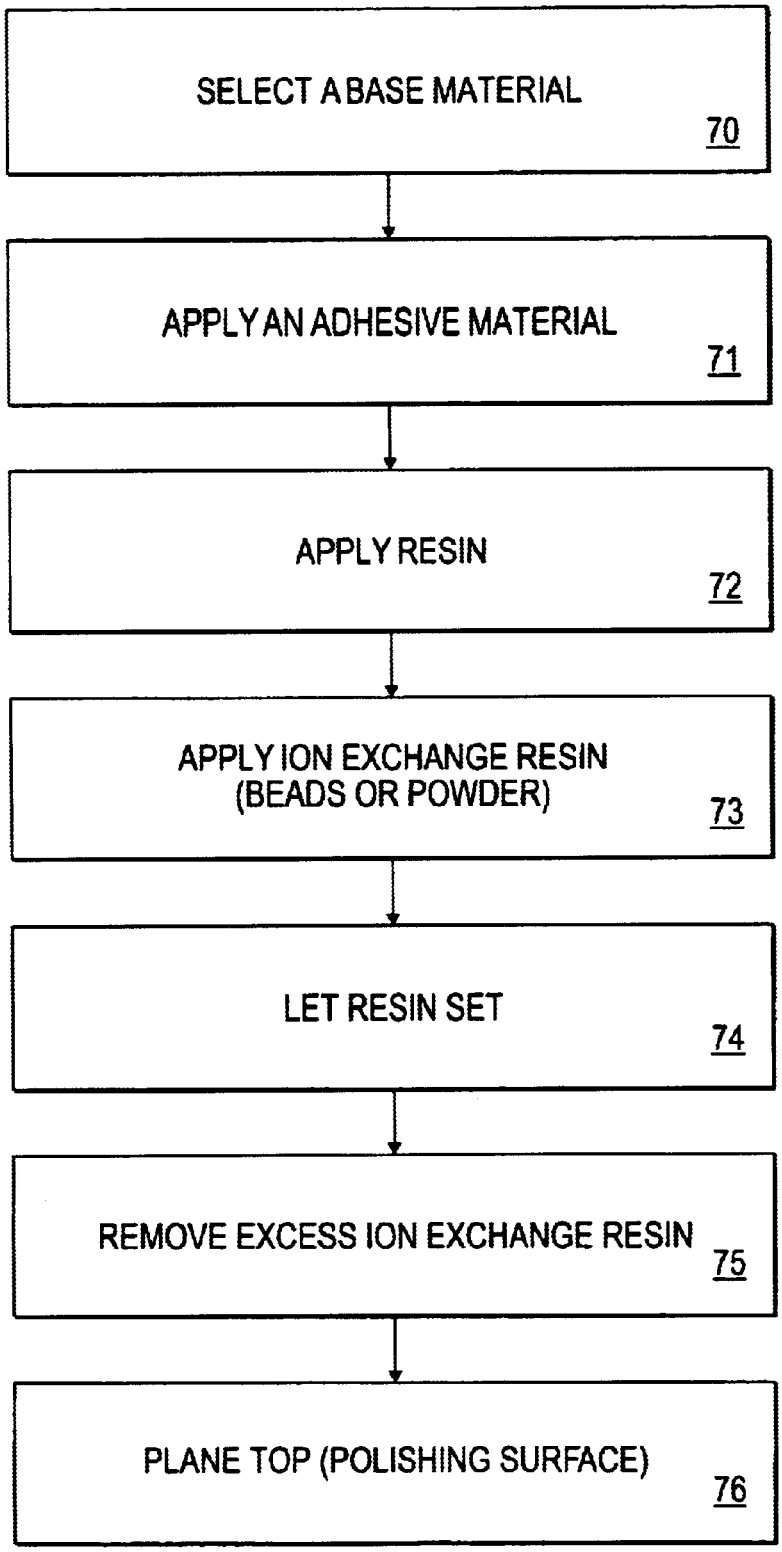
FIG. 7 represents an exemplary method of manufacture for an ion exchange pad.

Certain embodiments include methods for fabricating an ion exchange polish pad, as described herein. FIG. 7 is a flow chart of an exemplary fabrication process for an ion exchange polish pad. Block 70 represents the selection of a base material. Base materials may include, but are not limited to polyurethane, polycarbonate, polyurethane impregnated polyester felt pad, and other similar polymers known in the art. Block 71 represents the application of an adhesive material, for example product number 9275 LE manufactured by 3M corporation or similar adhesives to the base layer. A resin is then applied over the adhesive material (block 72). Block 73 represents the application of an ion exchange material, forms of which include, but are not limited to ion exchange resin beads, powder, or other forms. Alternatively, ion exchange functional groups may be coupled directly to a resin layer using coupling methods known in the art. The ion exchange material may be applied by pressing the ion exchange material into the surface of the resin. Alternatively, the ion exchange material is applied by mixing the ion exchange material with the resin before or during application of the resin over the adhesive material. After the application of an ion exchange material the resin is usually cured (block 74). After the resin has set excess ion exchange material may be removed from the ion exchange polish pad 75. The surface of the ion exchange polish pad may be machined or ground to produce a planar polishing surface 76.

Figure 8:
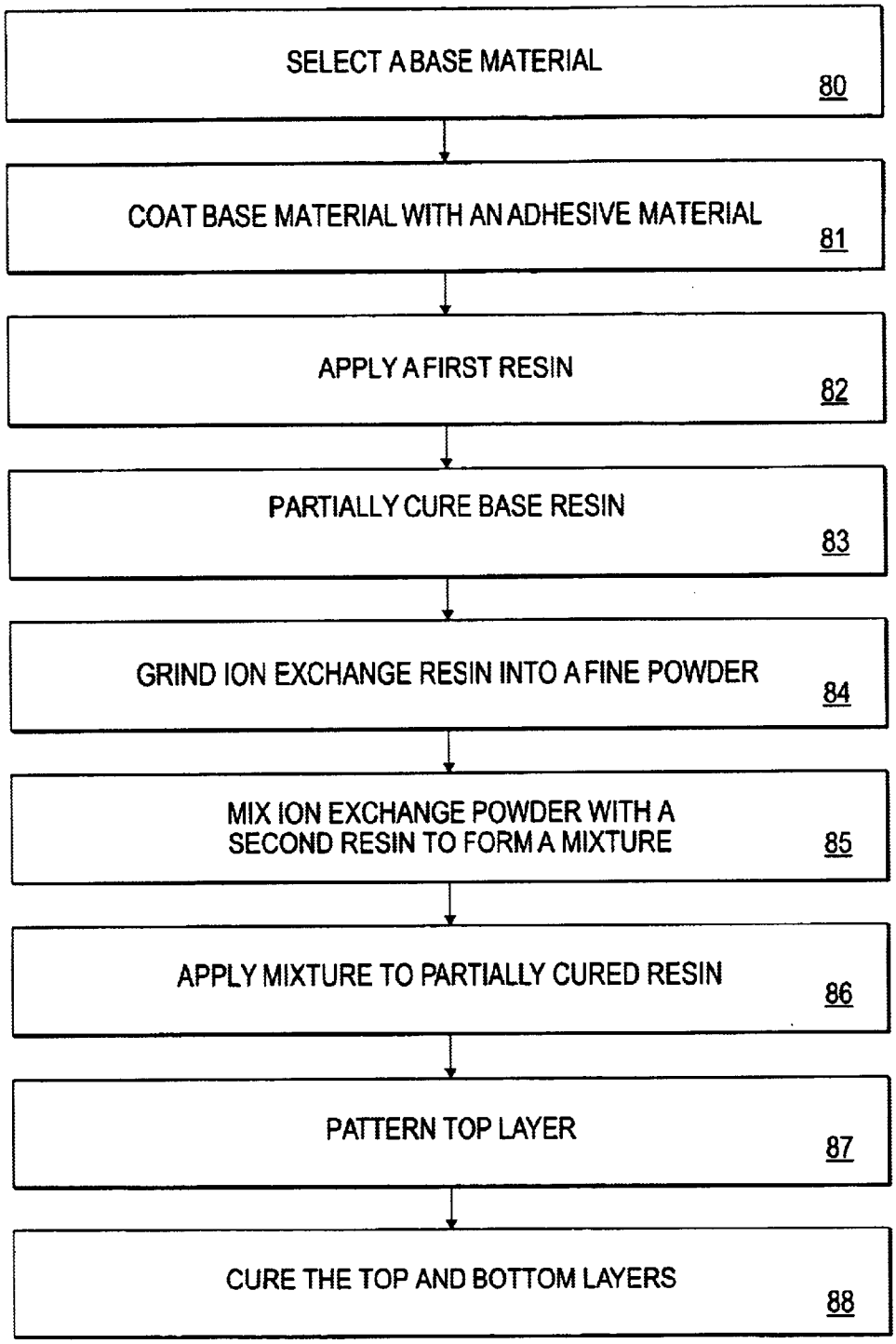
FIG. 8 represents an alternative embodiment of a method of manufacture for an ion exchange polish pad.

FIG. 8 illustrates an alternative embodiment for the fabrication of an ion exchange polish pad of the present invention. Block 80 represents a selection of an appropriate base material. Block 81 represents the coating of the base material with an adhesive material. A first resin is applied to the top surface of a selected base material 82. The first resin may then be partially cured (block 83). Block 84 represents grinding of an ion exchange resin into a fine powder. The ion exchange resin powder is combined with a second resin to form an ion exchange/resin mixture, block 85. The ion exchange/resin mixture is applied to the partially cured first resin of block 83 forming an ion exchange layer 86. The ion exchange layer of a polish pad may then patterned, block 87, followed by curing of the polish pad, block 88.

In alternative embodiments, the resin of block 82 may be patterned and then an ion exchange/resin mixture is coated on top of the patterned resin layer. In yet another alternative embodiments a desired pattern for an ion exchange layer may be imprinted or etched on a base material using stencil printing or similar processes prior to processing a base material. Thus, resulting in a patterned ion exchange polish pad.

Embodiments of the present invention employ materials including, but not limited to polymeric resins, binders, and/or adhesives known to a person skilled in the art for coupling a resin to an appropriate base material or a second resin layer. It is possible that an ion exchange material may interact with a resin, binder, or adhesive, thus compromising its ion binding properties. In alternative embodiments, an ion exchange resin ion-binding site may be protected by using an appropriate regenerable chemical moiety, for example Copper, prior to its introduction to a resin, binder, and/or adhesive matrix. The ion exchange resin ion-binding site may be made free of this protective moiety (conditioned) using methods such as those for reconditioning described herein.

Exemplary methods of fabricating ion exchange polish pads are disclosed herein, as well as exemplary methods for protection of an ion exchange resin during manufacture. Optimization of resin, binder, adhesive, substrate material, and/or pattern in combination with ion exchange resin may produce an integrated pad for optimum polishing performance.

Ion Exchange Material

Ion exchange materials have the ability to bind certain ions. Cationic exchange resins, when incorporated into a polishing pad, are used to remove unoxidized copper or other metal cations, to minimize dishing and erosion of interconnects and to manage metallic waste. A metal cation, such as copper, may be bound to an ion exchange resin and removed from the surface of a semiconductor substrate on which various layers have been formed. After binding an ion an ion exchange material may then be reconditioned by removing the bound cation by exchange with a hydrogen ion $H^+$ under appropriate process conditions. Thus, an ion exchange resin may be reconditioned repeatedly and its binding capacity regenerated.

Figure 9:
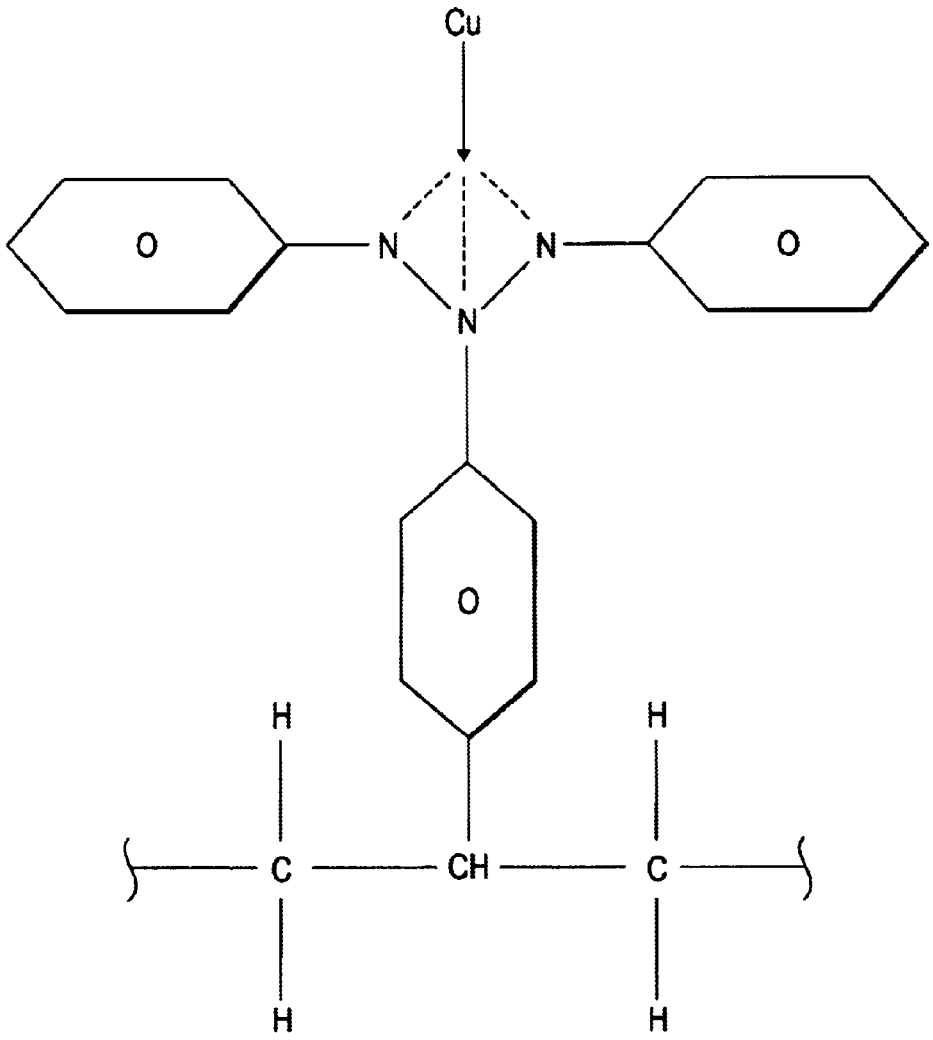
FIG. 9 illustrates an example of an amine-based copper-binding group.

A typical ion exchange material that may be used for manufacture of an ion exchange polish pad may posses a sulfonic or an amine based copper binding functional group, an example of which is shown in FIG. 9. The binding group may be co-polymerized with a polymer, for example a polymeric resin, or coupled directly to a resin for mechanical stability. Further, an ion exchange resin may be in the form of porous beads to maximize surface area. Numerous ion exchange resins are well known to one skilled in the art and readily available from commercial sources.

An ion exchange polish pad will typically need to be reconditioned by elution of bound cations as described above. Elution of captured cations may be followed by protonation of an ion exchange material. Reconditioning is needed due to an inherent inefficiency of an ion exchange material for binding an ion. An example of inefficient binding of Copper is illustrated using the commercially available ion exchange resin M4195 from Dow Chemicals (see FIG. 10 below). M4195 has 3 nitrogen atoms that provide a site to preferentially bind or complex a copper (Cu) atom. These nitrogen atoms are on benzene rings. Thus 3 modified benzene rings are needed for each Cu atom being captured. Each modified benzene ring has 2 atoms (6 carbon, 5 hydrogen, and 1 nitrogen). Therefore at least 36 atoms are used for capturing a Cu atom. If the atomic volumes were the same, then to remove approximately 1.5 $\mu$m of Cu, 1.5 $\mu$m×36=54 $\mu$m of resin would be required. However, copper atoms in the interconnect metallic film are more closely packed compared to the C, H, and N atoms of the benzene ring in the resin matrix. Also the resin is significantly porous compared to the copper metal film. Allowing a factor of 5 to account for the packing density and porosity mismatch, it can be said that polishing of about 1.5 $\mu$m thick Cu film will need about 54 $\mu$m×5=270 $\mu$m thick ion exchange material.

Figure 10:
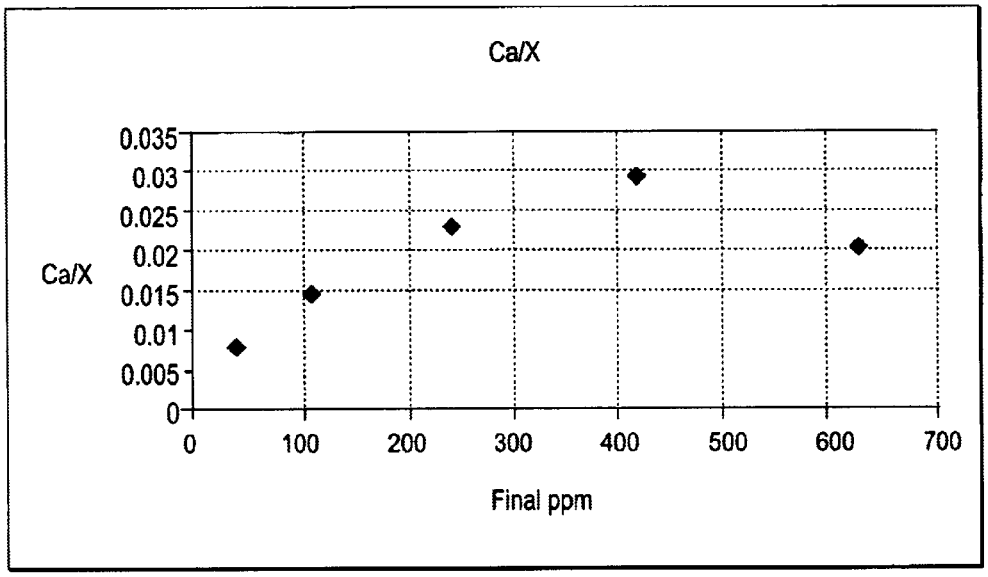
FIG. 10 illustrates an example of a copper to ion exchange resin pickup ratio.

This implies that an exemplary ion exchange polish pad with a nominal thickness of approximately 1.0 mm may not polish more than 4 wafers without regeneration. Experimental data indicates inefficiency in Cu to IER pickup ratio as shown in FIG. 10. Illustrated in FIG. 10 is an exemplary plot of the amount of copper in solution at equilibrium versus the ratio of the amount of copper adsorbed to the amount of ion exchange resin beads needed to reach the desired concentration of Cu in solution.

Figure 11:
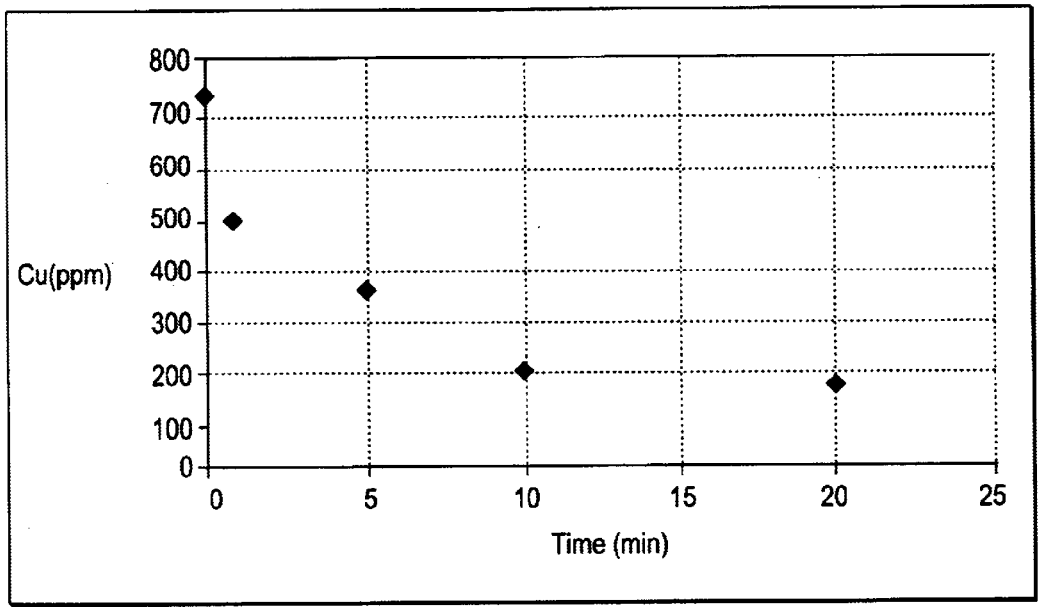
FIG. 11 illustrates an example of copper pick up efficiency from a copper sulfate ($CuSO_4$) solution as a function of time by ion exchange resin beads.

FIG. 11 shows ion exchange resin beads Cu pick up efficiency from a copper sulfate ($CuSO_4$) solution as a function of time. The amount of copper polished away in a typical CMP process run may be calculated as follows: 8" Cu wafer area=200 mm 200 mm×0.75=$3\times10^4$ $mm^2$=0.03 $m^2$. Assuming a 1.5 $\mu$m thick copper film the approximate volume of Cu removed=0.03 $m^2\times1.5\times10^{-6}$ m=$45.0\times10^{-9}$ $m^3$. Furthermore, considering the density of Copper=9000 kg $m^3$, the approximate weight of copper removed $45.0\times10^{-9}\times9000$ kg=405 mg or 0.40 gm. Assuming about 500 cc of water is used, then Cu ppm is=405×1000/500= approximately 810 ppm. From FIG. 10 it is derived that to remove 810 ppm of Cu from a Cu solution at least 810×150=121,000 mg or 121 gm of bead may be needed.

It was experimentally determined that 1 kg of beads were needed to make 20" square polish pad. These beads were adhered on a polymeric base material using a resin. Use of resin decreased the Cu pick up efficiency of the beads by 50%. Thus an ion exchange polish pad may be capable of polishing approximately 4 (500/121) wafers. An ion exchange polish pad will typically need to be reconditioned so that it can be used effectively.

Ion Exchange Polish Pad Reconditioning

In certain embodiments, an ion exchange polish pad may be conditioned and/or reconditioned to regenerate its binding capacity for ions, such as copper cations. After reconditioning, an ion exchange polish pad may bind and remove a cation from a surface, such as a copper layer on a silicon wafer. Once bound to an ion exchange polish pad, cations for example may be exchanged for protons ($H^+$) by exposing the ion exchange polish pad to a reconditioning medium(s). The exchange of cations with $H^+$ reconditions the ion exchange material of an ion exchange polish pad so it is capable of binding and removing additional cations from a surface. In other words, a reconditioning apparatus will refresh cation binding capacity of an ion exchange polish pad.

In certain embodiments, an apparatus may be used to recondition an ion exchange polish pad. A typical reconditioning process comprises elution of bound copper from ion exchange polish pad followed by protonation. Elution of bound copper may be accomplished by exposing an ion exchange polish pad to either an ammonium hydroxide solution or a strong 5 to 10 N sulfuric acid solution, or similar chemical treatments known in the art. Protonation is typically performed by exposing an ion exchange polish pad to a 1 N sulfuric acid solution. If sulfuric acid is used protonation will occur during the elution process. In certain embodiments, reconditioning is performed by using a reconditioning device or a reconditioning head, as described herein.

Figure 12:
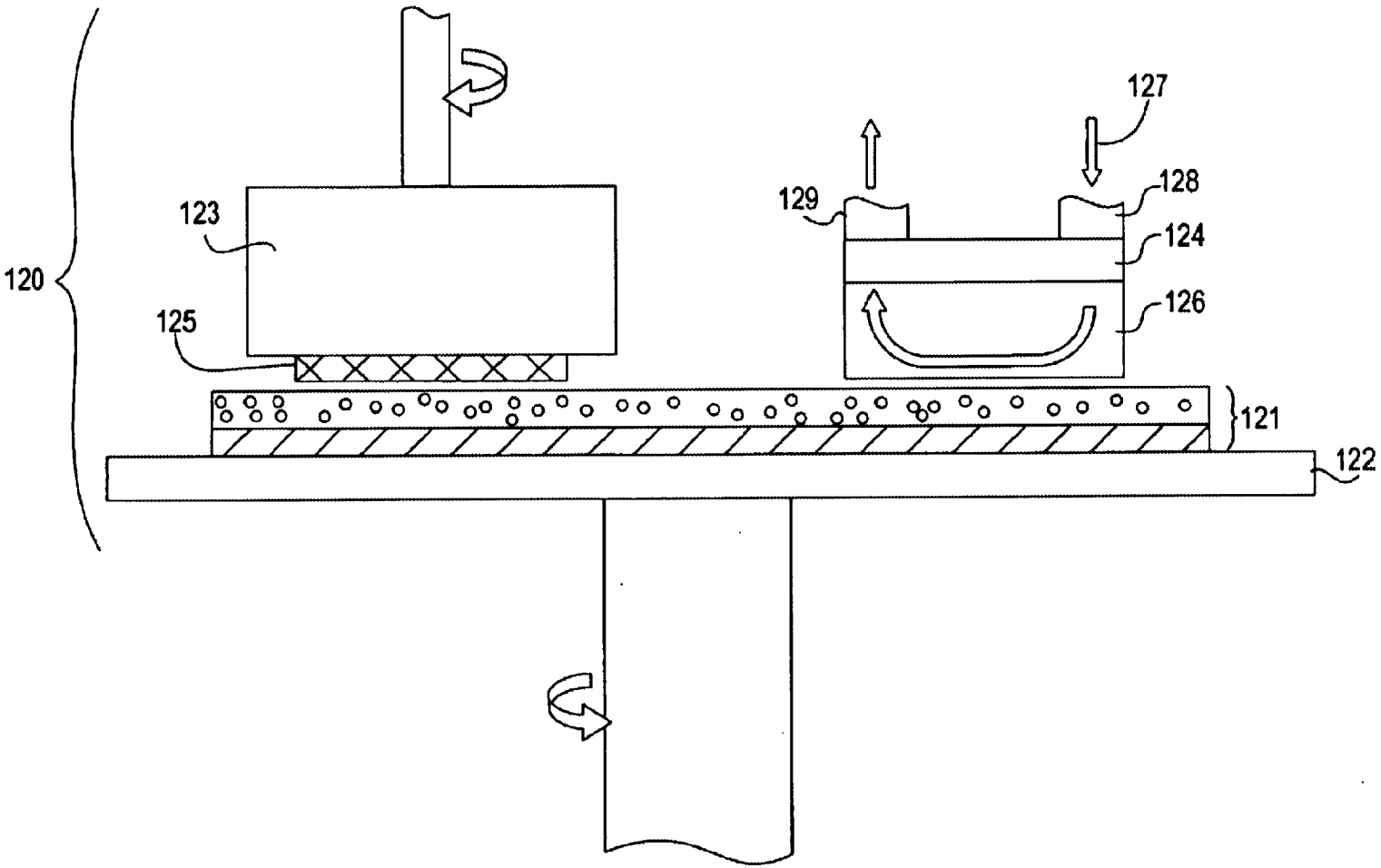
FIG. 12 illustrates an example of a reconditioning apparatus for an ion exchange polish pad.

One embodiment of a apparatus for reconditioning an ion exchange polish pad is illustrated in FIG. 12. The reconditioning apparatus 120 comprises an ion exchange polish pad 121 of the present invention, a polishing platform 122, a polishing head 123, and a reconditioning head 124 of the present invention. The ion exchange polish pad 121 is coupled to the polishing platform 122. Alternatively, the ion exchange pad may be coupled to the belt of a linear polisher. Also shown is a semiconductor substrate 125, which is coupled to the polishing head 123. The reconditioning head 124 is positioned so it contacts the ion exchange polish pad 121.

The reconditioning head 124 will have at least one reconditioning chamber 126 for solution transfer to and from the ion exchange pad 121 surface. A reconditioning solution 127 is applied through inlets 128 and removed through outlets 129. Although one inlet 128 and one outlet 129 are illustrated there may be a plurality of inlets 128 and outlets 129 depending on the overall rate of solution cycling. In other embodiments a plurality of reconditioning chambers 126 may be present in the reconditioning head 124. The inlet(s) 128 or outlet(s) 129 are in fluid communication with at least one reconditioning chamber 126 through which the reconditioning solution 127 applied and removed from the ion exchange polish pad 121 surface. The reconditioning of an ion exchange polish pad may be performed before, during or after polishing of the layers formed on a semiconductor substrate.

Figure 13:
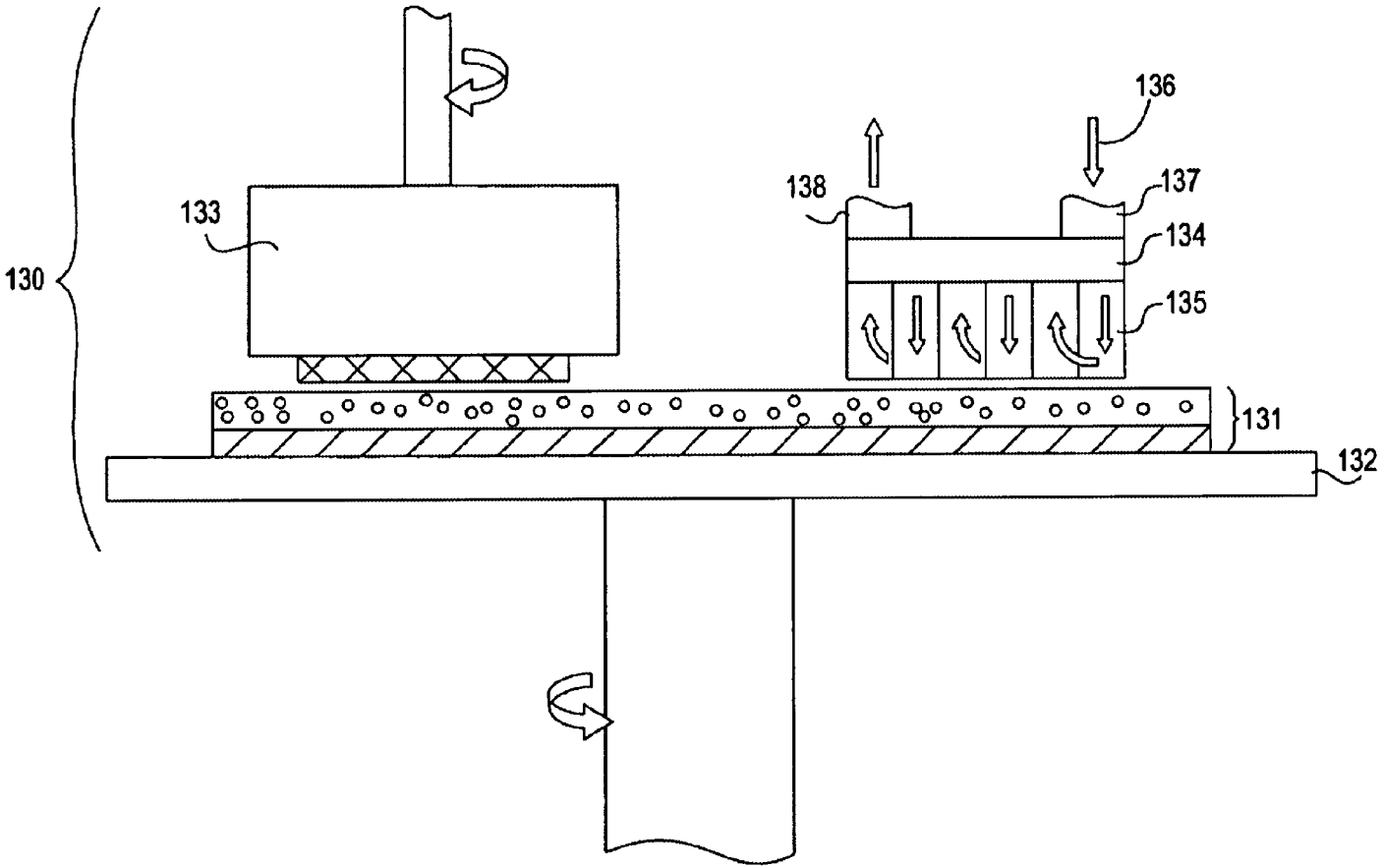
FIG. 13 illustrates an example of an alternative embodiment for a reconditioning apparatus for an ion exchange polish pad.

An alternative embodiment for reconditioning an ion exchange polish pad is illustrated in FIG. 13. The reconditioning apparatus 130 comprises an ion exchange polish pad 131 of the present invention, a polishing platform 132, a polishing head 133, and a reconditioning head 134 of the present invention. The arrangement and interaction of the elements are as described for FIG. 12. The illustrated embodiment includes a reconditioning head 134 that further comprises a plurality of reconditioning chambers 135. The reconditioning chambers 135 may be used a solution application chamber, a solution removal chamber, or a combination thereof. The reconditioning chambers 135 may be physically separated from at least one other reconditioning chamber 135.

In alternative embodiments reconditioning chambers 135 may be in fluid communication with other reconditioning chambers 135, including but not limited to adjacent reconditioning chambers. Reconditioning solution(s) 136 may flow through reconditioning chambers 135 in series or sub-combinations thereof and across the surface of an ion exchange polish pad. In certain embodiments the reconditioning solution(s) 136 may be directed by a manifold operatively connected to inlet(s) 137, outlets 138, and reconditioning chambers 135. Inlet(s) 137 will supply on demand the reconditioning solution(s) 136. The reconditioning solution(s) 136 contacts the ion exchange polish pad 131 surface within the confined perimeter of a reconditioning head 134. After elapse of a desired contact time the reconditioning solution(s) 136 is withdrawn from the reconditioning chamber 135 via the outlet(s) 138. Fluids may be transported by using vacuum, pressure, or other known forces or methods for moving fluids.

Figure 14:
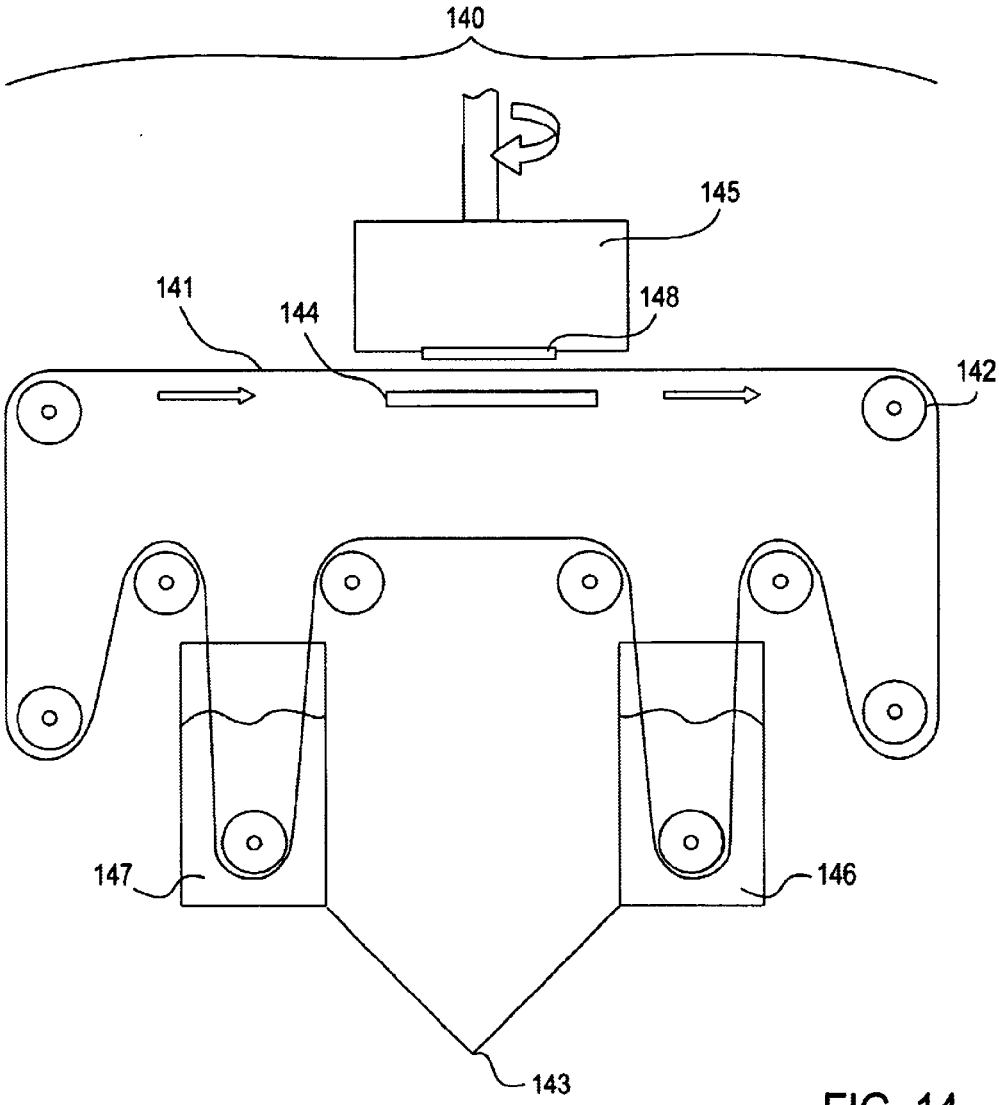
FIG. 14 illustrated is another exemplary embodiment of a reconditioning apparatus for an ion exchange polish pad.

Another alternative embodiment of a reconditioning apparatus for an ion exchange polish pad is diagrammed in FIG. 14. The reconditioning apparatus 140 comprises an ion exchange polish pad141 of the present invention coupled to a belt, rollers 142, reconditioning baths 143, a polishing platform 144, and a polishing head 145. The apparatus comprises a plurality of rollers 142 to support and move the ion exchange polish pad 141. The ion exchange polish pad 141 moves through the reconditioning baths 143, which contain reconditioning solution(s), for example elution solution 146 and protonating solution 147.

The ion exchange polish pad 141 is in contact with a semiconductor substrate 148, which is coupled to the polishing head 145 that positions the semiconductor substrate 148 appropriately. The polishing platform 144 is provided to support the ion exchange polish pad 141. Although FIG. 14 shows a single bath for an elution solution 146 and protonation solution 147, a plurality of reconditioning baths 143 may be provided so the ion exchange polish pad is exposed to various reconditioning solutions a plurality of times. In certain embodiments a reconditioning solution may provide for both elution and protonation, thus requiring a single reconditioning solution that may be present in one or more reconditioning baths 143.

Figure 15:
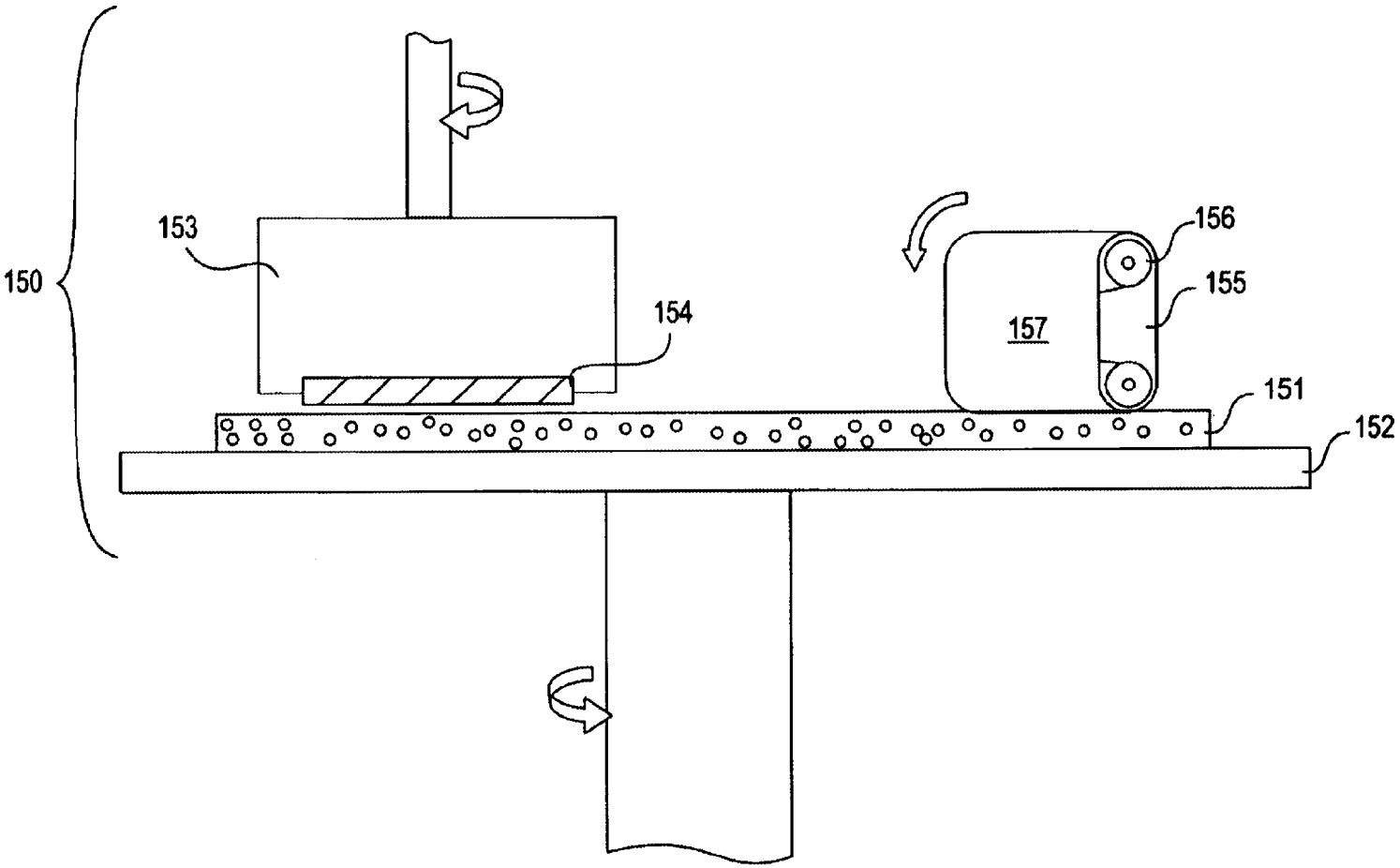
FIG. 15 illustrates yet another exemplary embodiment of a reconditioning apparatus for an ion exchange polish pad.

Yet another embodiment of a reconditioning apparatus is illustrated in FIG. 15. The reconditioning apparatus 150 comprises an ion exchange polish pad 151, a polishing platform 152, a polishing head 153 coupled to a semiconductor substrate 154, and a reconditioning head 155. The ion exchange polish pad is reconditioned by contacting the reconditioning head 155. The reconditioning head further comprises rollers 156 and a reconditioning belt 157. The reconditioning belt comprises an ion exchange material, which may be rotated while in reconditioning the ion exchange polish pad 151 and may exert a desired force to maintain appropriate contact. The reconditioning belt 157 is used at various rotating speeds and/or contact forces for reconditioning the ion exchange polish pad 151. The reconditioning belt 157 will bind and remove cations from ion exchange polish pad 151 and will typically have a substantial binding capacity. Alternatively, the reconditioning belt 157 can be regenerated using similar chemical processes described herein. In an alternative embodiment a regenerating belt may be used in conjunction with a linear belt polishing apparatus, such as that depicted in FIG. 14.

A variety of advantages may be achieved by the practice of the invention. These advantages include, but are not limited to, improved planarization efficiency, minimizing dishing and erosion, and simplifying waste management. One advantage of this process is that cations, such as copper, may be removed preferentially from regions of interconnect areas that contact the ion exchange polish pad. Advantages of using an ion exchange material include improved planarization efficiency of copper by removing cations from the surface of a deposited layer that contacts the ion exchange polish pad while minimizing dishing and erosion.

Another advantage of the invention is the effective management of byproducts by implementing proper ion exchange mechanisms, as described herein, thus simplifying waste treatment. Environmentally toxic by-products of a polishing process may be managed with an ion exchange mechanism much easier than managing waste in a conventional slurry. Thus, minimizing or possibly eliminating the need for a chemical slurry.

We claim:

1. A system, comprising:

an ion exchange polish pact, a reconditioning head having at least one chamber containing a reconditioning solution adapted to elute bound cations from and protonate ion exchange material to regenerate an ion exchange property of the ion exchange polish pad, the at least one chamber adapted to transfer the solution to and from a surface of the ion exchange polish pad, and having at least one inlet and at least one outlet, each in fluid communication with the chamber.

2. The system of claim 1 wherein the at least one camber comprises a plurality of chambers through which the reconditioning solution is permitted to flow.

3. The system of claim 1, wherein the reconditioning solution is comprised of separate solutions, a first solution to perform the elution of bound cations and a second solution to perform the protonation of the ion exchange material.

4. A method of reconditioning an ion exchange polishing pad, comprising eluting bound cations from and protonating ion exchange material of the ion exchange polishing pad to regenerate a cation binding capacity of the ion exchange material through use of one or more reconditioning solutions applied to the ion exchange material of the ion exchange polishing pad via a reconditioning head having a plurality of chambers for transferring the reconditioning solutions to and from the ion exchange polishing pad, the reconditioning solutions being introduced to the chambers through an inlet thereto and removed from the chambers through an outlet thereof, the inlet and the outlet being in fluid communication with the chambers.

5. A The method of claim 4, wherein the reconditioning solution comprises separate solutions, a first solution to perform the elution followed by a second solution to perform the protonation.

6. The method of claim 4, wherein the reconditioning solution includes a strong acid.

7. The method of claim 4, wherein the reconditioning solution is sulfuric acid.

* * * * *